US011035131B2

(12) United States Patent
Mo

(10) Patent No.: US 11,035,131 B2
(45) Date of Patent: Jun. 15, 2021

(54) WOODEN FLOOR WITH HIGH UTILIZATION, CONNECTION ASSEMBLY, AND CONNECTION STRUCTURE OF SAME

(71) Applicant: Jiagui Mo, Nanning (CN)

(72) Inventor: Jiagui Mo, Nanning (CN)

( * ) Notice: Subject to any disclaimer, the term of this patent is extended or adjusted under 35 U.S.C. 154(b) by 363 days.

(21) Appl. No.: 15/776,314

(22) PCT Filed: Mar. 22, 2018

(86) PCT No.: PCT/CN2018/079928

§ 371 (c)(1),
(2) Date: May 15, 2018

(87) PCT Pub. No.: WO2019/075989

PCT Pub. Date: Apr. 25, 2019

(65) Prior Publication Data

US 2020/0270873 A1 Aug. 27, 2020

(30) Foreign Application Priority Data

Oct. 16, 2017 (CN) ..... 201721327510.5
Dec. 7, 2017 (CN) ..... 201711284343.5

(51) Int. Cl.
*E04F 15/02* (2006.01)
*E04F 15/04* (2006.01)

(52) U.S. Cl.
CPC ..... *E04F 15/02005* (2013.01); *E04F 15/04* (2013.01)

(58) Field of Classification Search
CPC ..... E04F 15/02005; E04F 15/04
(Continued)

(56) References Cited

U.S. PATENT DOCUMENTS 4,599,841 A * 7/1986 Haid ..... E04F 15/04 52/396.04
6,374,563 B1 * 4/2002 Erskine ..... F27D 1/004 52/385

(Continued)

FOREIGN PATENT DOCUMENTS

CN 2537771 Y 2/2003
CN 201158920 Y 12/2008

(Continued)

*Primary Examiner* — Paola Agudelo
(74) *Attorney, Agent, or Firm* — Bayramoglu Law Offices LLC

(57) ABSTRACT

The invention discloses a wooden floor with high utilization, a connection assembly, and a connection structure of a wooden floor with high utilization and a connection assembly. The wooden floor with high utilization includes a floor body. The floor body defines a first groove on one side surface thereof in a horizontal direction. The floor body defines a second groove on the other side surface thereof in the horizontal direction. The first groove and/or the second groove define a notch. The floor body of the present invention is merely required to define grooves on two sides thereof, and is not necessary to provide a protruding male buckle, as long as the first groove or the second groove is connected with a male buckle of the connection assembly, so that wood can be saved, thus increasing a utilization rate of the wood. The wood saved by a single piece of wood floor is limited, but many a little makes a mickle. Moreover, two adjacent floor bodies can be connected by the groove to reserve a certain gap therebetween according to need, which can increase the air permeability of the floor. The use of wood can be greatly saved to protect the ever-decreasing trees, and benefit the human society.

2 Claims, 5 Drawing Sheets

(58) Field of Classification Search
USPC ..... 52/578
See application file for complete search history.

(56) References Cited

U.S. PATENT DOCUMENTS 6,564,522 B1* 5/2003 Chiu-Ying ..... E04F 15/225 52/403.1
6,619,000 B1* 9/2003 Chiu-Ying ..... E04F 15/04 269/291
9,528,277 B2* 12/2016 Prati ..... E04F 15/02044
2001/0027829 A1* 10/2001 Crout ..... E04F 15/04 144/353
2003/0009973 A1* 1/2003 Lee ..... E04F 15/04 52/589.1
2003/0070382 A1* 4/2003 Tseng ..... E04F 15/04 52/578
2003/0121226 A1 7/2003 Bolduc
2003/0177728 A1* 9/2003 Ku ..... E04F 15/105 52/403.1
2004/0016197 A1* 1/2004 Ruhdorfer ..... E04F 15/02 52/578
2005/0120651 A1* 6/2005 Lee ..... E04F 15/04 52/263
2006/0156664 A1* 7/2006 Chae ..... E04F 15/04 52/480
2011/0099931 A1* 5/2011 Lee ..... E04F 15/04 52/403.1
2013/0104493 A1* 5/2013 Orchard ..... E04F 15/02044 52/704
2014/0007526 A1* 1/2014 Wright ..... E04B 5/023 52/127.4
2016/0362902 A1* 12/2016 Lee ..... E04F 15/02044

FOREIGN PATENT DOCUMENTS

CN 202081612 U 12/2011
CN 104234373 A 12/2014
CN 105735608 A 7/2016

* cited by examiner

WOODEN FLOOR WITH HIGH UTILIZATION, CONNECTION ASSEMBLY, AND CONNECTION STRUCTURE OF SAME

CROSS-REFERANCE TO RELATED APPLICATIONS

This application is a United States National Stage Application filed under 35 U.S.C 371 of PCT Patent Application Serial No. PCT/CN2018/079928 , filed 22 Mar. 2018, which claims Chinese Patent Applications Serial No. CN 201711284343.5, filed 07 Dec. 2017 and Serial No. CN 201721327510.5, filed 16 Oct. 2017, the disclosure of all of which are hereby incorporated by reference in their entirety.

TECHNICAL FIELD

The present disclosure relates to wooden floors and connecting member thereof technical field, and more particularly relates to a wooden floor with high utilization, a connection assembly, and a connecting structure between the two.

BACKGROUND

Nowadays, a wooden floor, due to durability, non-radioactivity, good foot feel, warm in winter, cool in summer, artistic and natural, etc. thereof, is increasingly served as a installing material chosen by people for decoration. A shape of the wooden floor is usually a rectangular shape. One side of the wooden floor is provided with a female trough, and another side thereof is provided with a male buckle. When assembled, the female trough and the male trough are engaged with each other to complete a splicing work of the wooden floor, while a production of such wooden floor requires more woods to be used, which is harmful to the moment with reduced resources. Therefore, a wood floor that can use less wood and have a high wood utilization, and related mounting assembly thereof are required, and at the same time, a robust connection and an efficient installation efficiency are required.

SUMMARY

According to various embodiments of the present disclosure, a wooden floor with high utilization is provided, which includes a floor body. The floor body defines a first groove on one side surface thereof in a horizontal direction. The other side surface of the floor body defines a second groove in the horizontal direction. The first groove and/or the second groove define a notch.

Further, a connection assembly for connecting the wooden floor with high utilization is provided, which includes a connector main body. The connector main body is provided with a protruding clip protruding upwardly. The protruding clip includes a vertical portion and a first male buckle and a second male buckle located horizontally on opposite sides of a top end of the vertical portion. The first male buckle is used for matching the first groove. The second male buckle is used for matching the second groove.

Furthermore, a connection structure of a wooden floor with high utilization and a connection assembly is provided, which includes a floor body and the connection assembly. The floor body defines a first groove on one side surface thereof in the horizontal direction. The other side surface of the floor body defines a second groove in the horizontal direction. The first groove and/or the second groove define a notch. The connection assembly includes a connector main body. The connector main body is provided with a protruding clip protruding upwardly. The protruding clip includes a vertical portion, and a first male buckle and a second male buckle located horizontally on opposite sides of a top end of the vertical portion. The first male buckle of the connection assembly is received in the first groove of the floor body. The second male buckle of the connection assembly is received in the second groove of the floor body. The first male buckle is used for matching the first groove. The second male buckle is used for matching the second groove.

A beneficial effect of the connection structure of the wooden floor with high utilization and the connection assembly of the present disclosure is that, when installing the connection structure of the wooden floor with high utilization and the connection assembly, the first groove or the second groove of the wooden floor is connected with the first male buckle or the second male buckle of the connection assembly, which not only make an installation of the wooden floor simple and quick but also enable to reserve a certain gap by the groove connection between two adjacent floor bodies according to need, thus increasing an air permeability of the floor. Therefore, installing the wood floor using the connection structure of the wood floor with high utilization and the connection assembly of the present disclosure has advantages of saving man-hours and connecting firmly.

Details of one or more embodiments of the present disclosure are set forth in accompanying drawings and description below. Other features, objects, and advantages of the present disclosure will be apparent upon review of the description and drawings, and the claims.

BRIEF DESCRIPTION OF THE DRAWINGS

For a better description and explanation of embodiments and/or examples of the disclosures disclosed herein, reference can be made to one or more of the accompanying drawings. Additional details or illustrations used to describe the accompanying drawings should not be taken as a limitation to a scope of any one of the disclosed disclosure, presently described embodiments and/or examples, or currently considered as the best mode of these disclosures.

Figure 1:
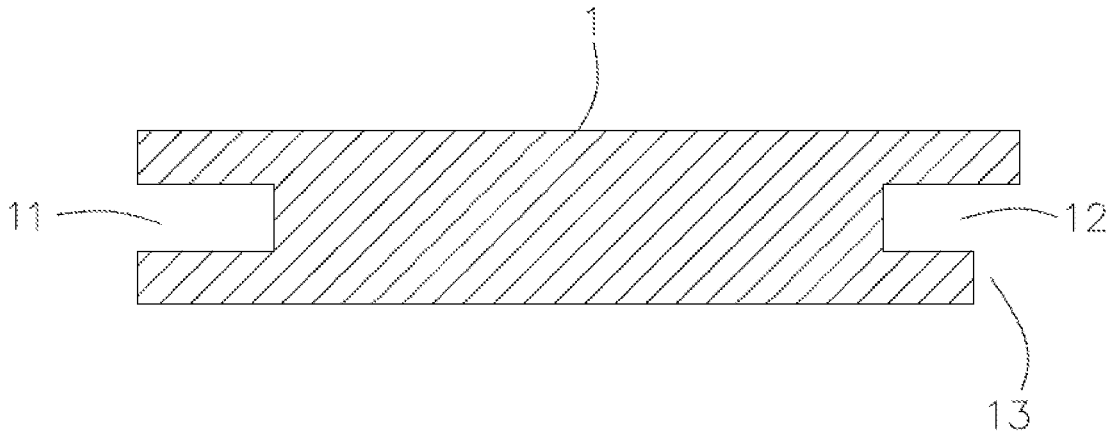
FIG. 1 is a first cross-sectional view of a wooden floor with high utilization.

Meanings of reference numerals in the drawings are as follow:

1, floor body; 11, first groove; 12, second groove; 13, notch; 2, connector main body; 21, vertical portion; 22, second male buckle; 23, first male buckle; 24, guide chute; 25, top plate; 26, fixed plate; 27, top pushing body; 28, accommodating cavity; 29, protruding block; 2*a*, connector main body; 21*a*, vertical portion; 22*a*, second male buckle; 23*a*, first male buckle; 24*a*, guide slide frame; 240*a*, guide groove; 25*a*, top plate; 27*a*, top pushing body; 28*a*, accommodating cavity; 29*a*, protruding block.

DETAILED DESCRIPTION OF THE EMBODIMENTS

Embodiments of the invention are described more fully hereinafter with reference to the accompanying drawings. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art. Elements that are identified using the same or similar reference characters refer to the same or similar elements.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element is referred to as being "connected" or "coupled" to another element, it can be directly connected or coupled to the other element or intervening elements may be present. In contrast, if an element is referred to as being "directly connected" or "directly coupled" to another element, there are no intervening elements present.

It will be understood that, although the terms first, second, etc. may be used herein to describe various elements, these elements should not be limited by these terms. These terms are only used to distinguish one element from another. Thus, a first element could be termed a second element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Embodiment 1

Referring to FIG. 1, the present disclosure provides a wooden floor with high utilization, which includes a floor body 1. The floor body 1 defines a first groove 11 on one side surface thereof in a horizontal direction. The floor body 1 defines a second groove 12 on the other side surface thereof in the horizontal direction. In the illustrated embodiment, the second groove 12 defines a notch 13. A length of an upper side edge of the second groove 12 protruding outwardly is greater than a length of a lower side edge thereof protruding outwardly.

In this embodiment, cross-sections of the first groove 11 and the second groove 12 are both rectangular, and the first groove 11 and the second groove 12 are respectively located in a middle portion of corresponding side surfaces, so that the upper side edge and the lower side edge of the floor body 1 can be evenly stressed to achieve better strength. It should be understood that in other embodiments, the first groove 11 and the second groove 12 can also be respectively located in a middle upper portion or a middle lower portion of corresponding side surfaces.

A depth of the first groove 11 is equal to a depth of the second groove 12. In other embodiments, the depth of the first groove 11 can be greater than the depth of the second groove 12.

Embodiment 2

Figure 2:
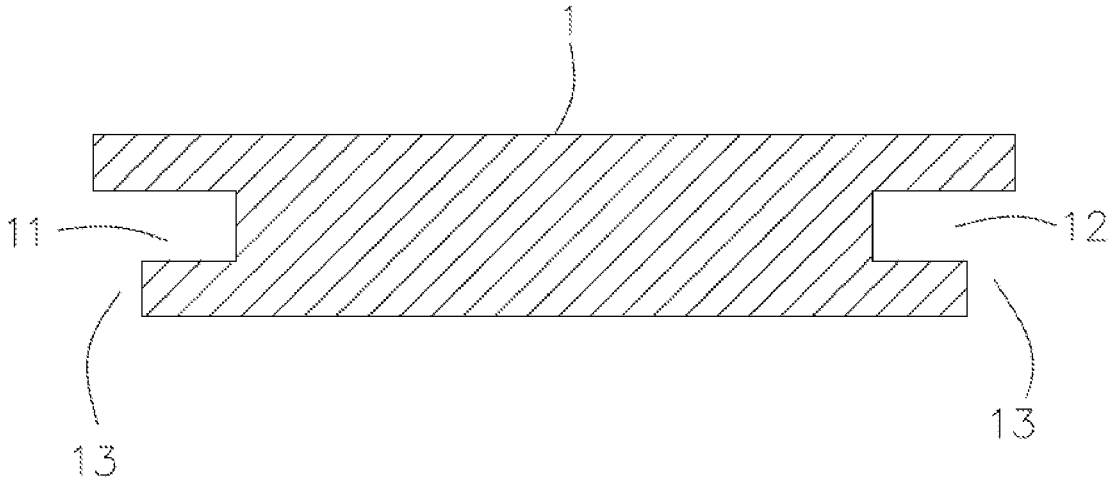
FIG. 2 is a second cross-cross-sectional view of a wooden floor with high utilization.

Referring to FIG. 2, the present disclosure provides a wooden floor with high utilization, which includes a floor body 1. The floor body 1 defines a first groove 11 on one side surface thereof in a horizontal direction. The floor body 1 defines a second groove 12 on the other side surface thereof in the horizontal direction. In the illustrated embodiment, both of the first groove 11 and the second groove 12 define a notch 13. A length of an upper side edge of the first groove 11 is greater than a length of a lower side edge thereof. A length of an upper side edge of the second groove 12 is greater than a length of a lower side edge thereof.

In this embodiment, cross-sections of the first groove 11 and the second groove 12 are both rectangular.

Embodiment 3

Figure 3:
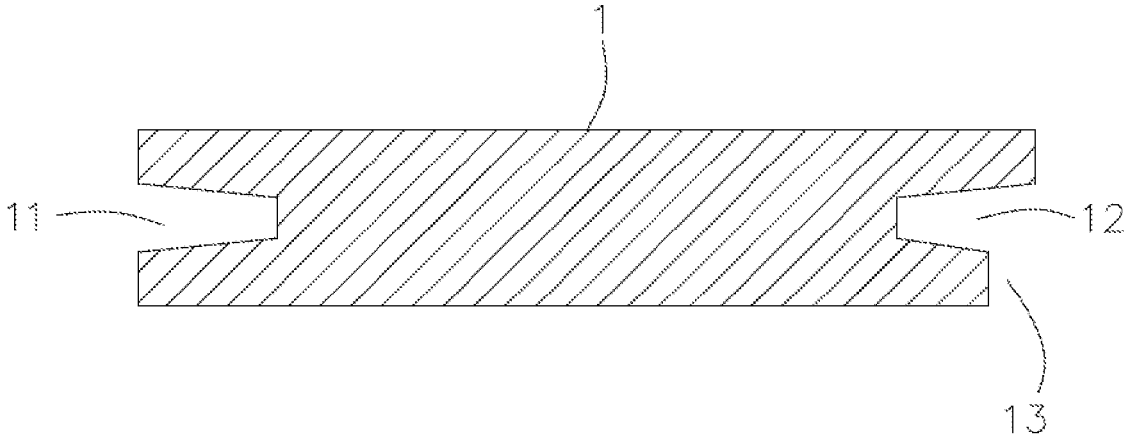
FIG. 3 is a third cross-sectional view of a wooden floor with high utilization.

Referring to FIG. 3, the present disclosure provides a wooden floor with high utilization, which includes a floor body 1. The floor body 1 defines a first groove 11 on one side surface thereof in a horizontal direction. The floor body 1 defines a second groove 12 on the other side surface thereof in the horizontal direction. In the illustrated embodiment, the second groove 12 defines a notch 13. A length of an upper side edge of the second groove 12 is greater than a length of a lower side edge thereof.

In this embodiment, width of each cross-section of the first groove 11 and the second groove 12 gradually widens from an inside to an outside. For example, cross-sections of the first groove 11 and the second groove 12 are both trumpet-shaped.

A depth of the first groove 11 is equal to a depth of the second groove 12. In other embodiments, the depth of the first groove 11 can be greater than the depth of the second groove 12.

Embodiment 4

Figure 4:
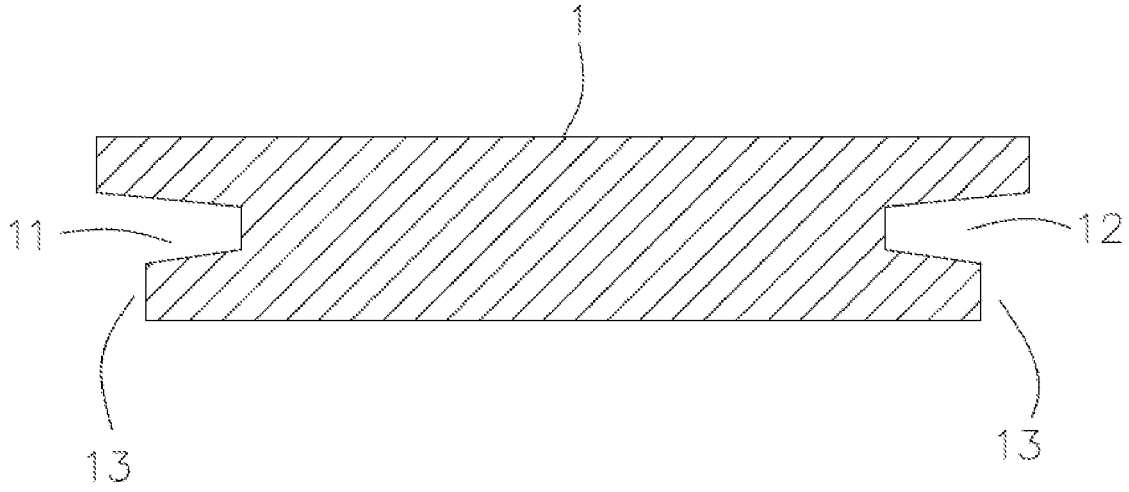
FIG. 4 is a fourth cross-sectional view of a wooden floor with high utilization.

Referring to FIG. 4, the present disclosure provides a wooden floor with high utilization, which includes the floor body 1. The floor body 1 defines a first groove 11 on one side surface thereof in a horizontal direction. The floor body 1 defines a second groove 12 on the other side surface thereof in the horizontal direction. In the illustrated embodiment, both of the first groove 11 and the second groove 12 define a notch 13. A length of an upper side edge of the first groove 11 is greater than a length of a lower side edge thereof. A length of an upper side edge of the second groove 12 is greater than a length of a lower side edge thereof.

In this embodiment, width of each cross-section of the first groove 11 and the second groove 12 gradually widens from an inner side to an outer side. For example, cross-sections of the first groove 11 and the second groove 12 are both trumpet-shaped.

Embodiment 5

Figure 5:
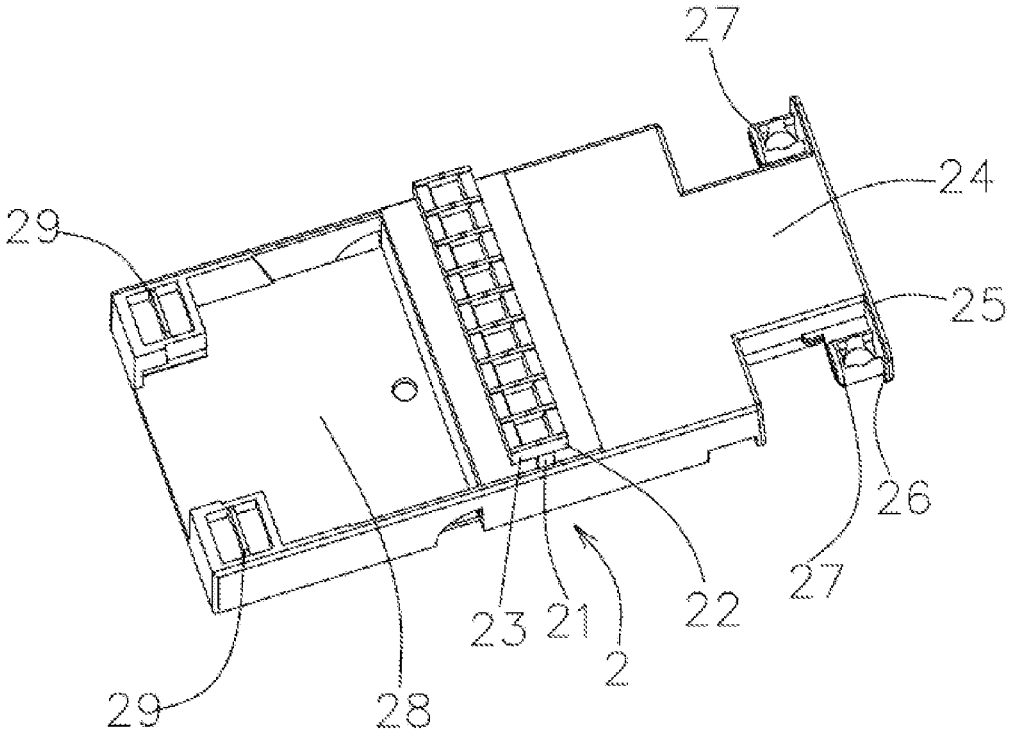
FIG. 5 is a schematic view of a connection assembly for connecting a wooden floor with high utilization.
Figure 6:
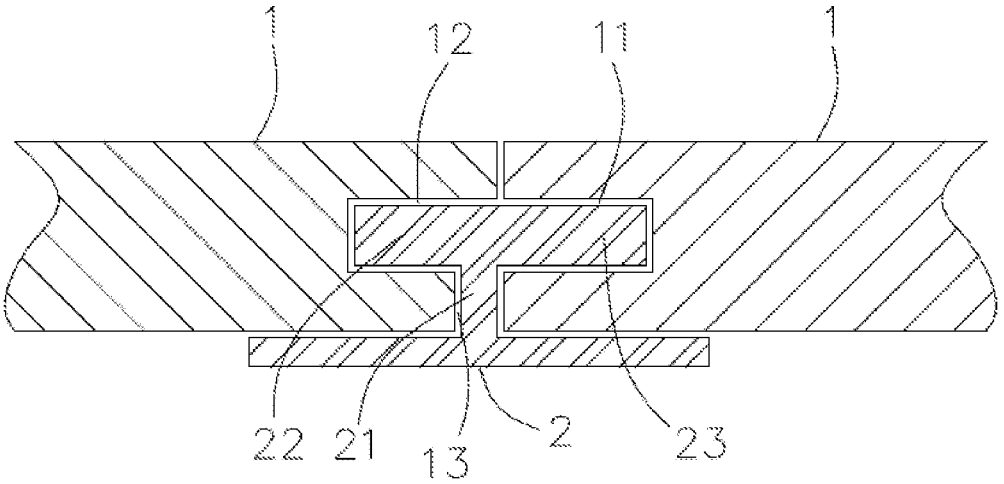
FIG. 6 is a first cross-sectional view of a connection structure of a wooden floor with high utilization and a connection assembly.

Referring to FIGS. 5 and 6, the present disclosure further provides a connection assembly for connecting a wooden floor with high utilization, which includes a connector main body 2. The connector main body 12 is provided with a protruding clip protruding upwardly. The protruding clip includes a vertical portion 21, and a first male buckle 23 and a second male buckle 22 located horizontally on opposite sides of a top end of the vertical portion 21. The first male buckle 23 matches the first groove 11 of the floor body 1. The second male buckle 22 matches the second groove 12 of the floor body 1.

A guide slide frame 24 is extended on one side of the connector main body 2. The guide slide frame 24 includes a top plate 25 parallel to the connector main body 2 on an outside. Two fixed plates 26 are connected between the top plate 25 and the connector main body 2. Two ends of an inner side of the top plate 25 are respectively provided with a horizontal top pushing body 27. The other end of the connector main body 2 defines an accommodating cavity 28 capable of accommodating the guide slide frame. Two opposite ends of an outer side of the accommodating cavity 28 are respectively provided with a protruding block 29. An inner side of the protruding block 29 facing the guide slide frame 24 horizontally defines a spring hole corresponding to the top pushing body 27. A spring (not shown in the figures) is horizontally installed in the spring hole. A connection between adjacent connector main bodies 2 can improve a connection stability of the floor body 1 installed thereon. During use, the guide slide frame 24 of the connector main body 2 is inserted into the accommodating cavity 28 of the adjacent connector bodies 2. The top pushing body 27 of the top plate 25 of the guide slide frame 24 is inserted into the spring hole in the protruding block 29. The spring in the spring hole is capable of stabilizing a stability of the top pushing body 27 therein. The connection between the connector main bodies 2 can increase a stability during a installing process of the wooden floor and a flatness of an installation, and putting the guide slide frame 24 into the accommodating cavity 28 is merely required without damaging the ground to installing a keel, and a installing efficiency thereof is high. The connector main body 2 is used in combination with the floor body 1 so that the floor installing effect thereof is good and the installing efficiency thereof is high.

Embodiment 6

Referring to FIG. 6, the present disclosure further provides a connection structure of a wooden floor with high utilization and a connection assembly. The connection structure includes a floor body 1 and a connection assembly 2. A first male buckle 23 of the connection assembly 2 is inserted into a first groove 11 of a floor body 1. A second male buckle 22 of the connecting assembly 2 is inserted into a second groove 12 of the floor body 1. An upper side edge of the first groove 11 is in contact with an upper side edge of the second groove 12. A lower side edge of the first groove 11 and a lower side edge of the second groove 12 respectively abut against opposite sides of a vertical portion 21.

In this embodiment, the floor body 1 defines the first groove 11 on one side surface thereof in a horizontal direction, and the floor body 1 defines the second groove 12 on the other side surface thereof in the horizontal direction. In this embodiment, the second groove 12 defines a notch 13. A length of the upper side edge of the second groove 12 is greater than a length of the lower side edge thereof.

In the illustrated embodiment, cross-sections of the first groove 11 and the second groove 12 are both rectangular.

A depth of the first groove 11 is equal to a depth of the second groove 12. In other embodiments, the depth of the first groove 11 can be greater than the depth of the second groove 12.

Embodiment 7

Figure 7:
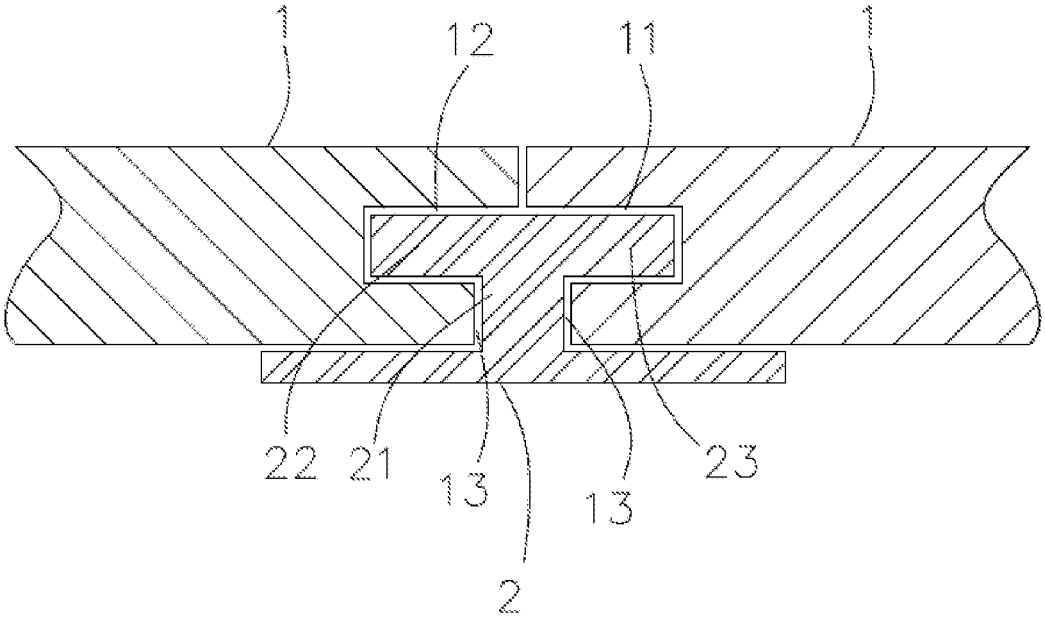
FIG. 7 is a second cross-sectional view of a connection structure of a wooden floor with high utilization and a connection assembly.

Referring to FIG. 7, the present disclosure further provides a connection structure of a wooden floor with high utilization and a connection assembly. The connection structure includes a floor body 1 and a connection assembly 2. A first male buckle 23 of the connection assembly 2 is inserted into a first groove 11 of the floor body 1. A second male buckle 22 of the connecting member 2 is inserted into a second groove 12 of the floor body 1. An upper side edge of the first groove 11 is in contact with an upper side of the second groove 12. A lower side edge of the first groove 11 and a lower side edge of the second groove 12 respectively abut against opposite sides of a vertical portion 21. The vertical portion 21 matches a combination of a notch 13 of the first groove 11 and a notch 13 of the second groove 12.

In this embodiment, the floor body 1 defines the first groove 11 on one side surface thereof in a horizontal direction. The floor body 1 defines the second groove 12 on the other side surface thereof in the horizontal direction. In this embodiment, both of the first groove 11 and the second groove 12 define a notch 13. A length of an upper side edge of the first groove 11 is greater than a length of the lower side edge thereof. A length of an upper side edge of the second groove 12 is greater than a length of the lower side edge thereof.

In the illustrated embodiment, cross-sections of the first groove 11 and the second groove 12 are both rectangular.

Embodiment 8

Figure 8:
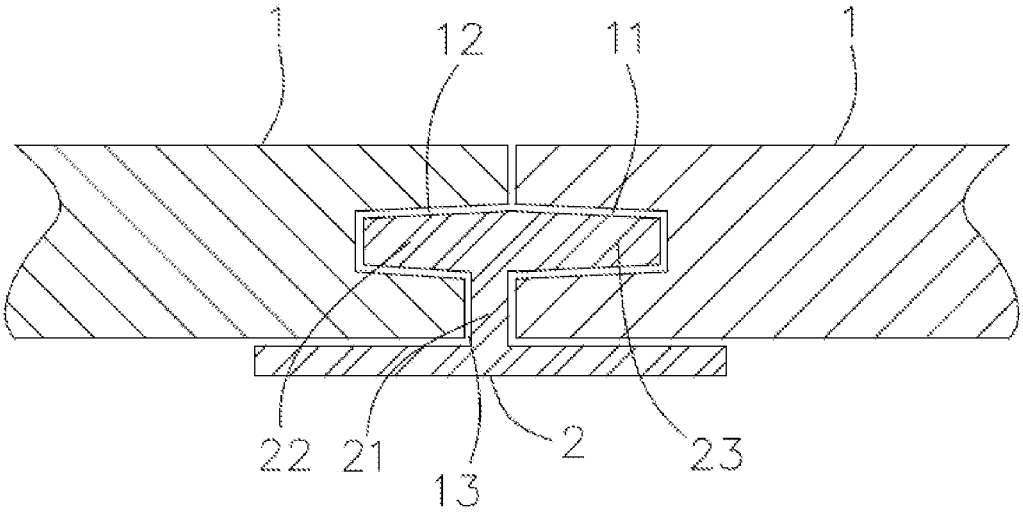
FIG. 8 is a third cross-sectional view of a connection structure of a wooden floor with high utilization and a connection assembly.

Referring to FIG. 8, the present disclosure further provides a connection structure of a wooden floor with high utilization and a connection assembly. The connection structure includes a floor body 1 and a connection assembly 2. A first male buckle 23 of the connection assembly 2 is inserted into a first groove 11 of the floor body 1. A second male buckle 22 of the connecting member 2 is inserted into a second groove 12 of the floor body 1. An upper side edge of the first groove 11 is in contact with an upper side edge of the second groove 12. A lower side edge of the first groove 11 and a lower side edge of the second groove 12 respectively abut against opposite sides of a vertical portion 21.

In this embodiment, the floor body 1 defines the first groove 11 on one side surface thereof in a horizontal direction. The floor body 1 defines the second groove 12 on the other side surface thereof in the horizontal direction. In this embodiment, the second groove 12 defines a notch 13. A length of an upper side edge of the second groove 12 is greater than a length of a lower side edge thereof.

In the illustrated embodiment, width of each cross-section of the first groove 11 and the second groove 12 gradually widens from an inner side toward an outer side. For example, cross-sections of the first groove 11 and the second groove 12 are both trumpet-shaped.

A depth of the first groove 11 is equal to a depth of the second groove 12. In other embodiments, the depth of the first groove 11 can be greater than the depth of the second groove 12.

Embodiment 9

Figure 9:
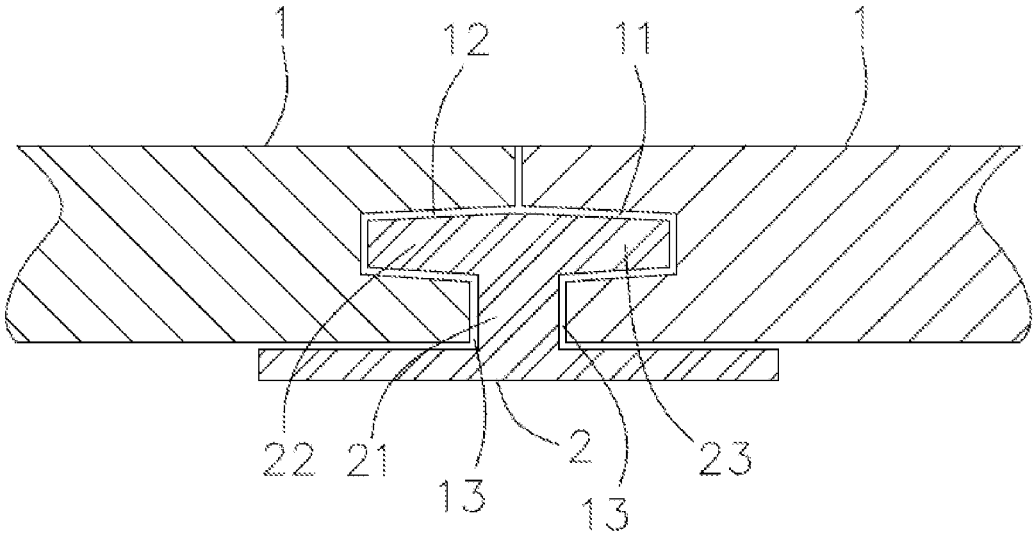
FIG. 9 is fourth cross-sectional view of a connection structure of a wooden floor with high utilization and a connection assembly.

Referring to FIG. 9, the present disclosure further provides a connection structure of a wooden floor with high utilization and a connection assembly. The connection structure includes a floor body 1 and a connection assembly 2. A first male buckle 23 of the connection assembly 2 is inserted into a first groove 11 of the floor body 1. A second male buckle 22 of the connecting assembly 2 is inserted into a second groove 12 of the floor body 1. An upper side edge of the first groove 11 is in contact with an upper side edge of the second groove 12. A lower side edge of the first groove 11 and a lower side edge of the second groove 12 respectively abut against opposite sides of a vertical portion 21.

In this embodiment, the floor body 1 defines the first groove 11 on one side surface thereof in a horizontal direction. The floor body 1 defines the second groove 12 on the other side surface thereof in the horizontal direction. In this embodiment, both of the first groove 11 and the second groove 12 define a notch 13. A length of an upper side edge of the first groove 11 is greater than a length of a lower side edge thereof. A length of an upper side edge of the second groove 12 is greater than a length of a lower side edge thereof.

In this embodiment, width of each cross-section of the first groove 11 and the second groove 12 gradually widens from an inner side to an outer side. For example, cross-sections of the first groove 11 and the second groove 12 are both trumpet-shaped.

Embodiment 10

Figure 10:
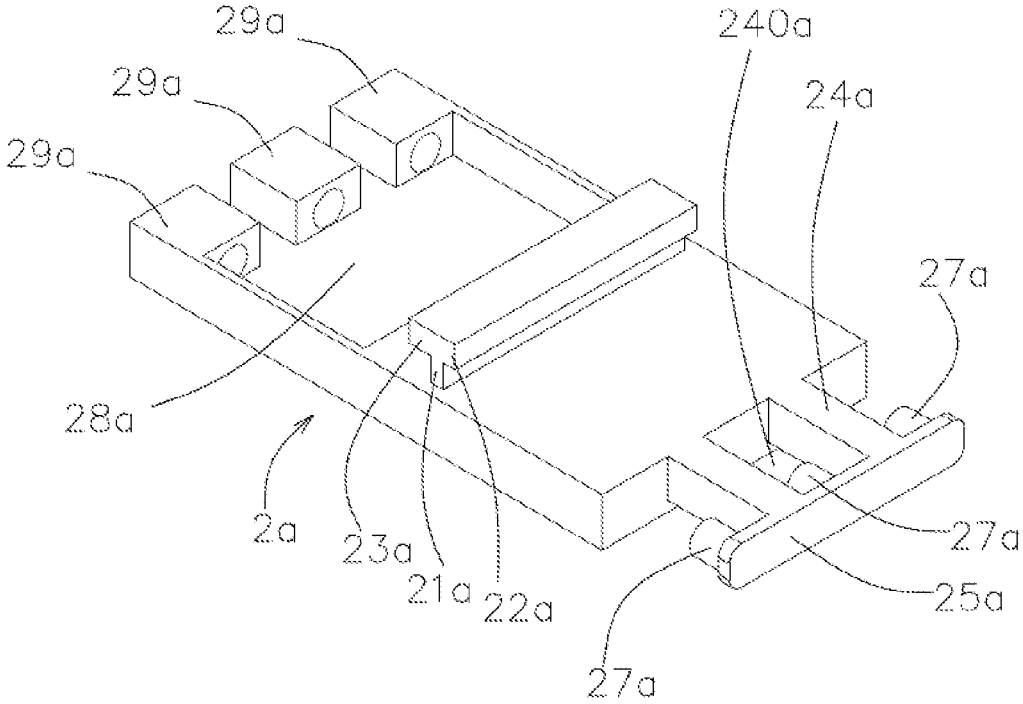
FIG. 10 is a schematic view of a connection assembly in accordance with another embodiment.

Referring to FIG. 10, the present disclosure further provides a connection assembly for connecting a wooden floor with high utilization. The connection assembly includes a connector main body 2*a*. The connector main body 2*a* is provided with a protruding clip protruding upwardly. The protruding clip includes a vertical portion 21*a* and a first male buckle 23*a* and a second male buckle 22*a* located horizontally on opposite sides of a top end of the vertical portion 21*a*. The first male buckle 23*a* matches a first groove 11 of a floor body 1. The second male buckle 22 matches a second groove 12 of the floor body 1.

A guide slide frame 24*a* is extended on one side of the connector main body 2*a*. A guide groove 240*a* is defined in a middle portion of the guide slide frame 24*a*. The guide slide frame 24*a* includes a top plate 25*a* parallel to the connector main body 2*a* on an outside. Two ends of an inner side of the top plate 25*a* and a middle portion thereof corresponding to guide groove 240*a* are respectively provided with a horizontal top pushing body 27*a*. The other end of the connector main body 2*a* defines an accommodating cavity 28*a* capable of accommodating the guide slide frame. A protruding block 29*a* is respectively formed on two opposite ends of an outer side of the accommodating cavity 28*a* and a middle portion thereof. An inner side of the protruding block 29*a* facing the guide slide frame 24*a* horizontally defines a spring hole corresponding to the top pushing body 27*a*. A spring (not shown in the figures) is horizontally installed in the spring hole. A difference from Embodiment 5 is that the number of each of the protruding blocks 29*a* and the top pushing body 27*a* of the connector main body 2*a* of the connection assembly of this embodiment is three, and three springs are matched so that during an assembly of two adjacent connector main bodies 2*a*, a force thereon is more even, the assembly thereof is more stable, and a combination thereof with the floor body 1 is stronger.

The above-mentioned embodiments merely present several embodiments of the present disclosure, which are described specifically and in detail but should not be interpreted as limit to the scope of the present disclosure. It should be noted that those skilled in the art may make various modifications and improvements without departing from the concept of the present disclosure, all of which fall in the protection scope of the present disclosure. Therefore, the protection scope of the present disclosure shall be subject to the appended claims.

What is claimed is:

1. A connection assembly, configured to connect a wooden floor that comprises floor bodies, each floor body having a top surface and a pair of opposite sides, cut outs formed in the sides consisting only of a first groove formed in one of the sides and a second groove formed in the other side, the grooves extend along a length of the floor body in a horizontal direction, wherein when the floor bodies are positioned side-by-side to construct the wooden floor, the first groove and/or the second groove define a notch, in which resides one of either a first or a second male buckle located at an end of a top of a centrally located upstanding T shaped clip, the connection assembly comprises a connector main body having a base with the centrally located upstanding T shaped clip extending a width of the base, a top of the T has the first and second male buckles located at each end, respectively, that fit into the notch defined by the first and second grooves of corresponding floor bodies when the floor bodies are positioned side-by-side to construct the wooden floor, a guide slide frame extending outwardly from one side of the connector main body, the guide slide frame has a top plate with a pushing body formed at one end and a pushing body formed at another end, and a central pushing body contained in a walled guide groove between the pushing body at the said one end and the pushing body at the said another end, and an accommodating cavity for receiving the guide slide frame of an adjacent connector main body extending outwardly from the other side of the connector main body, wherein a protruding block is located at an interior distal end of each opposite side wall of the accommodating cavity, and a third protruding block is located between the protruding blocks at the opposite side walls, wherein each of the protruding blocks contains a coil spring for urging a corresponding pushing body in a direction away from the protruding block so that adjacent connection assemblies are constantly urged in a direction toward the guide slide frame of an upstream connection assembly when the guide slide frame of an adjacent connection assembly is received in an accommodating cavity of an adjacent connector main body.

2. A connection assembly, configured to connect a wooden floor that comprises floor bodies, each floor body having a top surface and a pair of opposite sides, cut outs formed in the sides consisting only of a first groove formed in one of the sides and a second groove formed in the other side, the grooves extend along a length of the floor body in a horizontal direction, wherein when the floor bodies are positioned side-by-side to construct the wooden floor, the first groove and/or the second groove define a notch, in which resides one of either a first or a second male buckle located at an end of a top of a centrally located upstanding T shaped clip, the connection assembly comprises a connector main body having a base with the centrally located upstanding T shaped clip extending a width of the base, a top of the T has the first and second male buckles located at each end, respectively, that fit into the notch defined by the first and second grooves of corresponding floor bodies when the floor bodies are positioned side-by-side to construct the wooden floor, a guide slide frame extending outwardly from one side of the connector main body, and a pushing body is located at interior distal ends of each opposing side wall of the guide slide frame, and an accommodating cavity for receiving the guide slide frame of an adjacent connector main body extends outwardly from the other side of the connector main body, wherein a protruding block is located at interior distal ends of each opposite side wall of the accommodating cavity, wherein each of the protruding blocks contains a coil spring for urging a corresponding pushing body in a direction away from the protruding block so that adjacent connection assemblies are constantly urged in a direction toward the guide slide frame of an upstream connection assembly when the guide slide frame of an adjacent connection assembly is received in an accommodating cavity of an adjacent connector main body.

* * * * *